US011834900B2

(12) United States Patent
Horn et al.

(10) Patent No.: US 11,834,900 B2
(45) Date of Patent: Dec. 5, 2023

(54) MOTORIZED DYNAMIC SHADE WITH ELECTROSTATIC HOLDING, AND/OR ASSOCIATED METHODS

(71) Applicant: Guardian Glass, LLC, Auburn Hills, MI (US)

(72) Inventors: Lindsay Horn, Auburn Hills, MI (US); John Matuszewski, Auburn Hills, MI (US); Jason Theios, Auburn Hills, MI (US)

(73) Assignee: GUARDIAN GLASS, LLC, Auburn Hills, MI (US)

( * ) Notice: Subject to any disclaimer, the term of this patent is extended or adjusted under 35 U.S.C. 154(b) by 0 days.

(21) Appl. No.: 16/947,007

(22) Filed: Jul. 15, 2020

(65) Prior Publication Data

US 2022/0018184 A1 Jan. 20, 2022

(51) Int. Cl.
*E06B 9/32* (2006.01)
*E06B 9/44* (2006.01)
*E06B 9/72* (2006.01)

(52) U.S. Cl.
CPC ..... *E06B 9/32* (2013.01); *E06B 9/44* (2013.01); *E06B 9/72* (2013.01)

(58) Field of Classification Search
CPC ..... E06B 9/32; E06B 9/44; E06B 9/72; E06B 9/08; E06B 9/70; E06B 2009/1511; E06B 9/17046; E06B 2009/2643; E06B 9/40; E06B 9/42; E06B 9/24; E06B 9/68; E06B 2009/2464; G09F 9/372
See application file for complete search history.

(56) References Cited

U.S. PATENT DOCUMENTS 3,989,357 A * 11/1976 Kalt ..... G02B 26/02 359/231
4,266,339 A * 5/1981 Kalt ..... G02B 26/02 29/829

(Continued)

FOREIGN PATENT DOCUMENTS

FR 2996244 A1 * 4/2014 ..... E06B 9/24
WO 03031759 A2 4/2003

OTHER PUBLICATIONS

U.S. Appl. No. 16/792,348, filed Feb. 17, 2020; Gu et al.

(Continued)

*Primary Examiner* — Daniel P Cahn
*Assistant Examiner* — Matthew R. Shepherd

(57) ABSTRACT

Certain example embodiments relate to a motor-driven dynamic shade provided in an insulating glass (IG) unit, and/or associated methods. A spacer system helps maintain first and second substrates in substantially parallel spaced apart relation to one another and defines a gap therebetween. A shade and a motor are provided in the gap. The motor, provided close to a first peripheral edge of the IG unit, is dynamically controllable to cause the shade to extend towards a second peripheral edge of the IG unit opposite the first peripheral edge and to cause the shade to retract from the second peripheral edge towards the first peripheral edge. The shade may be electrostatically couplable to one of the first and second substrates when the shade is extended via complementary electrostatic connection areas provided to the shade and the one of the first and second substrates.

21 Claims, 7 Drawing Sheets

(56) References Cited

U.S. PATENT DOCUMENTS 4,649,980 A * 3/1987 Kunz ..... E06B 9/24 160/98
5,048,245 A 9/1991 Bresson et al.
5,784,189 A * 7/1998 Bozler ..... G02B 26/0833 359/254
6,887,575 B2 5/2005 Neuman et al.
7,056,588 B2 6/2006 Neuman et al.
7,189,458 B2 3/2007 Ferreira et al.
7,198,851 B2 4/2007 Lemmer et al.
7,645,977 B2 * 1/2010 Schlam ..... E06B 9/24 250/214 B
7,705,826 B2 4/2010 Kalt et al.
7,710,235 B2 * 5/2010 Storaska ..... B82Y 30/00 336/122
7,771,830 B2 8/2010 Neuman et al.
7,998,320 B2 8/2011 Laird et al.
8,035,075 B2 10/2011 Schlam et al.
8,134,112 B2 3/2012 Schlam et al.
8,557,391 B2 10/2013 Frank et al.
8,668,990 B2 3/2014 Broadway et al.
8,736,938 B1 * 5/2014 Schlam ..... E06B 3/00 359/230
8,982,441 B2 3/2015 Schlam et al.
9,556,066 B2 1/2017 Frank et al.
9,670,092 B2 6/2017 Lemmer et al.
9,695,085 B2 7/2017 Lemmer et al.
9,796,619 B2 10/2017 Broadway et al.
9,802,860 B2 10/2017 Frank et al.
10,151,566 B2 * 12/2018 Adrain ..... E06B 9/68
10,794,110 B2 * 10/2020 Vandal ..... G02B 26/02
10,895,102 B2 * 1/2021 Frey ..... B32B 17/1088
10,927,592 B2 * 2/2021 Blush ..... B32B 27/286
2005/0269041 A1 12/2005 Anderson et al.
2012/0243068 A1 * 9/2012 Yeh ..... E06B 9/264 359/275
2014/0202643 A1 * 7/2014 Hikmet ..... E06B 9/40 160/5
2014/0237917 A1 * 8/2014 Theios ..... C03C 17/366 52/203
2014/0272314 A1 9/2014 Veerasamy
2014/0338846 A1 * 11/2014 Hikmet ..... E06B 9/68 160/310
2016/0302605 A1 * 10/2016 Seitz ..... A47H 23/02
2017/0298686 A1 * 10/2017 Cheng ..... E06B 9/386
2018/0163461 A1 * 6/2018 Hall ..... E06B 9/42
2018/0305978 A1 * 10/2018 Whitmire ..... E06B 9/50
2019/0298098 A1 * 10/2019 Ma ..... A47H 23/04
2020/0011119 A1 * 1/2020 Krasnov ..... C23C 28/00
2020/0011120 A1 1/2020 Blush et al.
2020/0011121 A1 * 1/2020 Blush ..... B32B 7/12
2020/0011123 A1 * 1/2020 Petrmichl ..... E06B 9/264
2021/0238913 A1 * 8/2021 Koskulics ..... E06B 3/6722
2021/0238914 A1 * 8/2021 Koskulics ..... E06B 9/264
2021/0254397 A1 * 8/2021 Gu ..... E06B 3/66

OTHER PUBLICATIONS

International Search Report and Written Opinion received for PCT Application No. PCT/IB2021/056377, dated Oct. 29, 2021, 10 Pages.

* cited by examiner

MOTORIZED DYNAMIC SHADE WITH ELECTROSTATIC HOLDING, AND/OR ASSOCIATED METHODS

TECHNICAL FIELD

Certain example embodiments of this invention relate to shades that may be used with insulating glass units (IG units or IGUs), IG units including such shades, and/or methods of making the same. More particularly, certain example embodiments of this invention relate to motor-driven shades that may be used with IG units, IG units including such shades, and/or methods of making the same.

BACKGROUND AND SUMMARY

The building sector is known for its high energy consumption, which has been shown to represent 30-40% of the world's primary energy expenditure. Operational costs, such as heating, cooling, ventilation, and lighting account for the better part of this consumption, especially in older structures built under less stringent energy efficiency construction standards.

Windows, for example, provide natural light, fresh air, access, and connection to the outside world. However, they oftentimes also represent a significant source of wasted energy. With the growing trend in increasing the use of architectural windows, balancing the conflicting interests of energy efficiency and human comfort is becoming more and more important. Furthermore, concerns with global warming and carbon footprints are adding to the impetus for novel energy efficient glazing systems.

In this regard, because windows are usually the "weak link" in a building's isolation, and considering modern architectural designs that often include whole glass facades, it becomes apparent that having better insulating windows would be advantageous in terms of controlling and reducing energy waste. There are, therefore, significant advantages both environmentally and economically in developing highly insulating windows.

Insulating glass units (IG units or IGUs) have been developed and provide improved insulation to buildings and other structures, and FIG. 1 is a cross-sectional, schematic view of an example IG unit. In the FIG. 1 example IG unit, first and second substrates 102 and 104 are substantially parallel and spaced apart from one another. A spacer system 106 is provided at the periphery of the first and second substrates 102 and 104, helping to maintain them in substantially parallel spaced apart relation to one another and helping to define a gap or space 108 therebetween. The gap 108 may be at least partially filled with an inert gas (such as, for example, Ar, Kr, Xe, and/or the like) in some instances, e.g., to improve the insulating properties of the overall IG unit. Optional outer seals may be provided in addition to the spacer system 106 in some instances.

Windows are unique elements in most buildings in that they have the ability to "supply" energy to the building in the form of winter solar gain and daylight year around. Current window technology, however, often leads to excessive heating costs in winter, excessive cooling in summer, and often fails to capture the benefits of daylight, that would allow lights to be dimmed or turned off in much of the nation's commercial stock.

Thin film technology is one promising way of improving window performance. Thin films can, for example, be applied directly onto glass during production, on a polymer web that can be retrofitted to an already pre-existing window at correspondingly lower cost, etc. And advances have been made over the last two decades, primarily in reducing the U-value of windows through the use of static or "passive" low-emissivity (low-E) coatings, and by reducing the solar heat gain coefficient (SHGC) via the use of spectrally selective low-E coatings. Low-E coatings may, for example, be used in connection with IG units such as, for example, those shown in and described in connection with FIG. 1. However, further enhancements are still possible.

For instance, it will be appreciated that it would be desirable to provide a more dynamic IG unit option that takes into account the desire to provide improved insulation to buildings and the like, takes advantage of the ability of the sun to "supply" energy to its interior, and that also provides privacy in a more "on demand" manner. It will be appreciated that it would be desirable for such products to have a pleasing aesthetic appearance, as well.

Certain example embodiments address these and/or other concerns. For instance, certain example embodiments of this invention relate to electric, potentially-driven shades that may be used with IG units, IG units including such shades, and/or methods of making the same.

In certain example embodiments, an insulating glass (IG) unit is provided. First and second substrates each have interior and exterior major surfaces, with the interior major surface of the first substrate facing the interior major surface of the second substrate. A spacer system helps to maintain the first and second substrates in substantially parallel spaced apart relation to one another and to define a gap therebetween. A shade is interposed between the first and second substrates. A motor is proximate to a first peripheral edge of the IG unit and interposed between the first and second substrates, with the motor being dynamically controllable to cause the shade to extend towards a second peripheral edge of the IG unit opposite the first peripheral edge and to cause the shade to retract from the second peripheral edge towards the first peripheral edge.

In certain example embodiments, a method of making an insulating glass (IG) unit is provided. The method comprises having first and second substrates, each having interior and exterior major surfaces, the interior major surface of the first substrate facing the interior major surface of the second substrate; providing a motor connected to a shade; and connecting the first and second substrates to one another in substantially parallel, spaced apart relation, such that a gap is defined therebetween and such that the shade and the motor are located in the gap, with the motor being proximate to a first peripheral edge of the IG unit, the motor being dynamically controllable in use to cause the shade to extend towards a second peripheral edge of the IG unit opposite the first peripheral edge and to cause the shade to retract from the second peripheral edge towards the first peripheral edge.

In certain example embodiments, a method of operating a dynamic shade in an insulating glass (IG) unit is provided. The method comprises having an IG unit made in accordance with the techniques disclosed herein; and selectively activating the power source to move the polymer substrate between the shutter open and closed positions.

The features, aspects, advantages, and example embodiments described herein may be combined to realize yet further embodiments.

BRIEF DESCRIPTION OF THE DRAWINGS

These and other features and advantages may be better and more completely understood by reference to the following detailed description of exemplary illustrative embodiments in conjunction with the drawings, of which.

DETAILED DESCRIPTION

Figure 1:
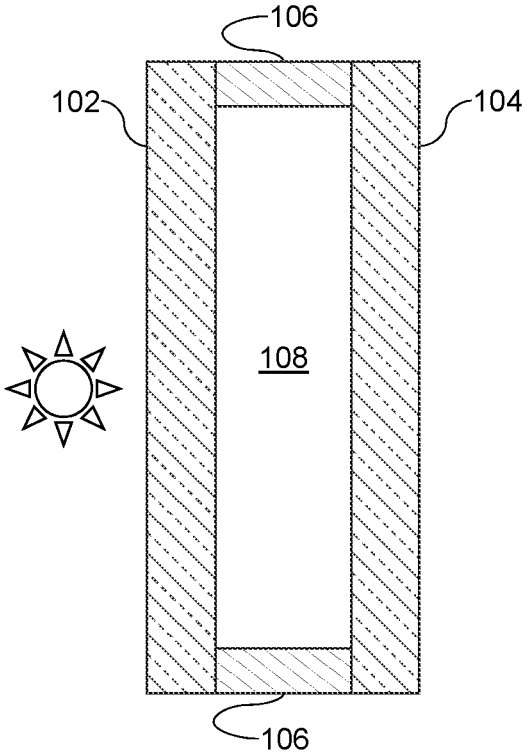
FIG. 1 is a cross-sectional, schematic view of an example insulating glass unit (IG unit or IGU)
Figure 2:
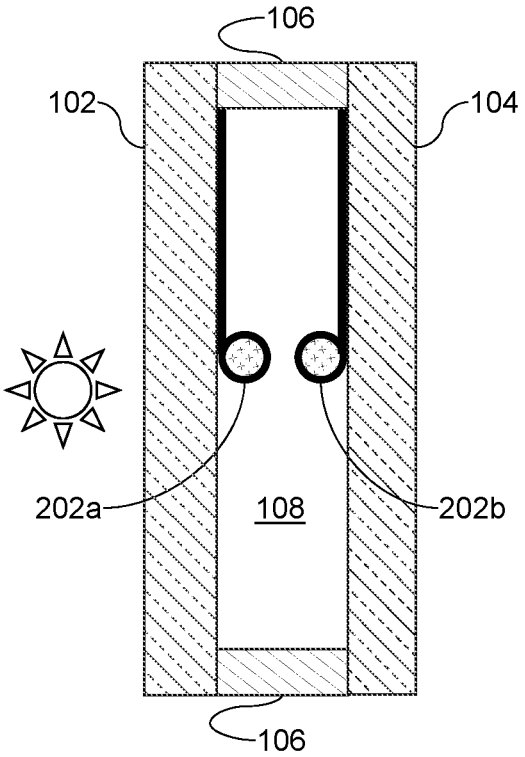
FIG. 2 is a cross-sectional, schematic view of an example IGU incorporating electric potentially-driven shades that may be used in connection with certain example embodiments.

Certain example embodiments of this invention relate to electric, potentially-driven shades that may be used with IG units, IG units including such shades, and/or methods of making the same. Referring now more particularly to the drawings, FIG. 2 is a cross-sectional, schematic view of an example insulating glass unit (IG unit or IGU) incorporating electric potentially-driven shades that may be used in connection with certain example embodiments. More specifically, FIG. 2 is similar to FIG. 1 in that first and second substantially parallel spaced apart glass substrates 102 and 104 are separated from one another using a spacer system 106, and a gap 108 is defined therebetween. First and second electric potentially-driven shades 202*a* and 202*b* are provided in the gap 108, proximate to inner major surfaces of the first and second substrates 102 and 104, respectively. As will become clearer from the description provided below, the shades 202*a* and 202*b* are controlled by the creation of an electric potential difference between the shades 202*a* and 202*b*, and conductive coatings formed on the inner surfaces of the substrates 102 and 104. As also will become clearer from the description provided below, each of shades 202*a* and 202*b* may be created using a polymer film coated with a conductive coating (e.g., a coating comprising a layer including Al, Cr, ITO, and/or the like). An aluminum-coated shade may provide for partial-to-complete reflection of visible light, and up to significant amounts of total solar energy.

The shades 202*a* and 202*b* are normally retracted (e.g., rolled up), but they rapidly extend (e.g., roll out) when an appropriate voltage is applied, in order to cover at least a portion of the substrates 102 and 104 much like, for example, a "traditional" window shade. The rolled-up shade may have a very small diameter, and typically will be much smaller than the width of the gap 108 between the first and second substrates 102 and 104, so that it can function between them and be essentially hidden from view when rolled up. The rolled-out shades 202*a* and 202*b* adhere strongly to the adjacent substrates 102 and 104.

The shades 202*a* and 202*b* extend along all or a portion of a vertical length of the visible or "framed" area of the substrates 102 and 104 from a retracted configuration to an extended configuration. In the retracted configuration, the shades 202*a* and 202*b* have a first surface area that substantially permits radiation transmission through the framed area. In the extended configuration, the shades 202*a* and 202*b* have a second surface area that substantially controls radiation transmission through the framed area. The shades 202*a* and 202*b* may have a width that extends across all or a portion of the horizontal width of the framed area of the substrates 102 and 104 to which they are attached.

Each of the shades 202*a* and 202*b* is disposed between the first and second substrates 102 and 104, and each preferably is attached at one end to an inner surface thereof (or a dielectric or other layer disposed thereon), near the tops thereof. An adhesive layer may be used in this regard. The shades 202 and 204 are shown partially rolled out (partially extended) in FIG. 2. The shades 202*a* and 202*b* and any adhesive layer or other mounting structure preferably are hidden from view so that the shades 202*a* and 202*b* are only seen when at least partially rolled out.

The diameter of a fully rolled-up shade preferably is about 1-5 mm but may be greater than 5 mm in certain example embodiments. Preferably, the diameter of a rolled-up shade is no greater than the width of the gap 108, which is typically about 10-15 mm, in order to help facilitate rapid and repeated roll-out and roll-up operations. Although two shades 202*a* and 202*b* are shown in the FIG. 2 example, it will be appreciated that only one shade may be provided in certain example embodiments, and it also will be appreciated that that one shade may be provided on an inner surface of either the inner or outer substrate 102 or 104. In example embodiments where there are two shades, the combined diameter thereof preferably is no greater than the width of the gap 108, e.g., to facilitate roll-out and roll-up operations of both shades.

An electronic controller may be provided to help drive the shades 202*a* and 202*b*. The electronic controller may be electrically connected to the shades 202*a* and 202*b*, as well as the substrates 102 and 104, e.g., via suitable leads or the like. The leads may be obscured from view through the assembled IG unit. The electronic controller is configured to provide an output voltage to the shades 202*a* and 202*b*. Output voltage in the range of about 100-800 V DC (e.g., 100-500 V DC or 300-800 V DC) can be used for driving the shades 202*a* and 202*b* in certain example embodiments. An external AC or DC power supply, a DC battery, and/or the like may be used in this regard. It will be appreciated that higher or lower output voltage may be provided, e.g., depending on the fabrication parameters and materials that comprise the shades 202*a* and 202*b*, the layers on the substrates 102 and 104, etc.

The controller may be coupled to a manual switch, remote (e.g., wireless) control, or other input device, e.g., to indicate whether the shades 202*a* and 202*b* should be retracted or extended. In certain example embodiments, the electronic controller may include a processor operably coupled to a memory storing instructions for receiving and decoding control signals that, in turn, cause voltage to be selectively applied to control the extension and/or retraction of the shades 202*a* and 202*b*. Further instructions may be provided so that other functionality may be realized. For instance, a timer may be provided so that the shades 202*a* and 202*b* can be programmed to extend and retract at user-specified or other times, a temperature sensor may be provided so that the shades 202*a* and 202*b* can be programmed to extend and retract if user-specified indoor and/or outdoor temperatures are reached, light sensors may be provided so that the shades 202*a* and 202*b* can be programmed to extend and retract based on the amount of light outside of the structure, etc.

Although two shades 202*a* and 202*b* are shown in FIG. 2, as noted above, certain example embodiments may incorporate only a single shade. Furthermore, as noted above, such shades may be designed to extend vertically and horizontally along and across substantially the entire IG unit, different example embodiments may involve shades that cover only portions of the IG units in which they are disposed. In such cases, multiple shades may be provided to deliver more selectable coverage, to account for internal or external structures such as muntin bars, to simulate plantation shutters, etc.

In certain example embodiments, a locking restraint may be disposed at the bottom of the IGU, e.g., along its width, to help prevent the shades from rolling out their entire lengths. The locking restraint may be made from a conductive material, such as a metal or the like. The locking restraint also may be coated with a low dissipation factor polymer such as, for example, polypropylene, fluorinated ethylene propylene (FEP), polytetrafluoroethylene (PTFE), and/or the like.

Figure 3:
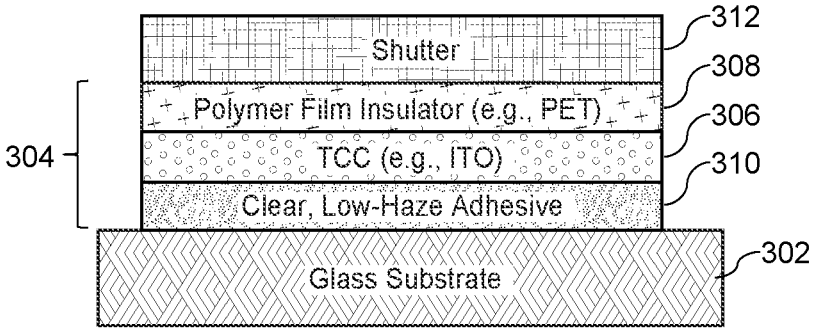
FIG. 3 is a cross-sectional view showing example on-glass components from the FIG. 2 example IGU that enable shutter action, in accordance with certain example embodiments.
Figure 4:
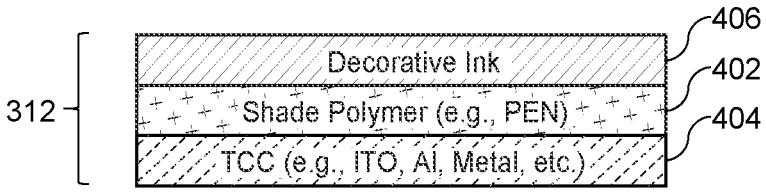
FIG. 4 is a cross-sectional view of an example shutter from the FIG. 2 example IGU, in accordance with certain example embodiments.

Example details of the operation of the shades 202*a* and 202*b* will now be provided in connection with FIGS. 3-4. More particularly, FIG. 3 is a cross-sectional view showing example on-glass" components from the FIG. 2 example IGU that enable shutter action, in accordance with certain example embodiments; and FIG. 4 is a cross-sectional view of an example shutter from the FIG. 2 example IGU, in accordance with certain example embodiments. FIG. 3 shows a glass substrate 302, which may be used for either or both of the substrates 102 and 104 in FIG. 2. The glass substrate 302 supports on-glass components 304, as well as the shutter 312. In certain example embodiments, when unrolled, the conductor 404 may be closer to the substrate 302 than the ink layer 406. In other example embodiments, this arrangement may be reversed such that, for example, when unrolled, the conductor 404 may be farther from the substrate 302 than the ink layer 406.

The on-glass components 304 include a transparent conductor 306, along with a dielectric material 308, which may be adhered to the substrate 302 via a clear, low-haze adhesive 310 or the like. These materials preferably are substantially transparent. In certain example embodiments, the transparent conductor 306 is electrically connected via a terminal to a lead to the controller. In certain example embodiments, the transparent conductor 306 serves as a fixed electrode of a capacitor, and the dielectric material 308 serves as the dielectric of this capacitor. In such cases, a dielectric or insulator film is provided, directly or indirectly, on the first conductive layer, with the dielectric or insulator film being separate from the shutter.

It will be appreciated that it is possible to put all of the dielectric layers on the shade in certain example embodiments, thereby exposing a bare conductive (flat) substrate, e.g., a glass substrate supporting a conductive coating. For example, in certain example embodiments, the polymer film insulator 308 may be provided on/integrated as a part of the shutter 312, rather than being provided on/integrated as a part of the substrate 302. That is, the shutter 312 may further support a dielectric or insulator film 308 thereon such that, when the at least one polymer substrate is in the shutter closed position and the shutter is extended, the dielectric or insulator film directly physically contacts the first conductive layer with no other layers therebetween.

The transparent conductor 306 may be formed from any suitable material such as, for example, ITO, tin oxide (e.g., $SnO_2$ or other suitable stoichiometry), etc. The transparent conductor 306 may be 10-500 nm thick in certain example embodiments. The dielectric material 308 may be a low dissipation factor polymer in certain example embodiments. Suitable materials include, for example, polypropylene, FEP, PTFE, polyethyleneterephthalate (PET), polyimide (PI), and polyethylenenapthalate (PEN), etc. The dielectric material 308 may have a thickness of 4-25 microns in certain example embodiments. The thickness of the dielectric material 308 may be selected so as to balance reliability of the shade with the amount of voltage (e.g., as thinner dielectric layers typically reduce reliability, whereas thicker dielectric layers typically require a high applied voltage for operational purposes).

As is known, many low-emissivity (low-E) coatings are conductive. Thus, in certain example embodiments, a low-E coating may be used in place of the transparent conductor 306 in certain example embodiments. The low-E coating may be a silver-based low-E coating, e.g., where one, two, three, or more layers comprising Ag may be sandwiched between dielectric layers. In such cases, the need for the adhesive 310 may be reduced or completely eliminated.

The shutter 312 may include a resilient layer 402. In certain example embodiments, a conductor 404 may be used on one side of the resilient layer 402, and a decorative ink 406 optionally may be applied to the other side. In certain example embodiments, the conductor 404 may be transparent and, as indicated, the decorative ink 406 is optional. In certain example embodiments, the conductor 404 and/or the decorative ink 406 may be translucent or otherwise impart coloration or aesthetic features to the shutter 312. In certain example embodiments, the resilient layer 402 may be formed from a shrinkable polymer such as, for example, PEN, PET, polyphenylene sulfide (PPS), polyether ether ketone (PEEK), etc. The resilient layer 402 may be 1-25 microns thick in certain example embodiments. The conductor 404 may be formed from the same or different material as that used for conductor 306, in different example embodiments. Metal or metal oxide materials may be used, for example. In certain example embodiments, a 10-50 nm thick material including a layer comprising, for example, ITO, Al, Ni, NiCr, tin oxide, and/or the like, may be used. In certain example embodiments, the resistance of the conductor 404 may be in the range of 40-200 ohms/square.

The decorative ink 406 may include pigments, particles, and/or other materials that selectively reflect and/or absorb desired visible colors and/or infrared radiation.

As FIG. 2 shows, the shades 202*a* and 202*b* ordinarily are coiled as spiral rolls, with an outer end of the spiral affixed by an adhesive to the substrates 102 and 104 (e.g., or the dielectric thereon). The conductor 404 may be electrically connected via a terminal to a lead or the like and may serve as a variable electrode of a capacitor having the conductor 306 as its fixed electrode and the dielectric 308 as its dielectric.

When an electrical drive is provided between the variable electrode and the fixed electrode, e.g., when an electric drive of voltage or current is applied between the conductor 404 of the shutter 312 and the conductor 306 on the substrate 302, the shutter 312 is pulled toward the substrate 302 via an electrostatic force created by the potential difference between the two electrodes. The pull on the variable electrode causes the coiled shade to roll out. The electrostatic force on the variable electrode causes the shutter 312 to be held securely against the fixed electrode of the substrate 302. As a result, the ink coating layer 406 of the shade selectively reflects or absorbs certain visible colors and/or infrared radiation. In this way, the rolled-out shade helps control radiation transmission by selectively blocking and/or reflecting certain light or other radiation from passing through the IG unit, and thereby changes the overall function of the IG unit from being transmissive to being partially or selectively transmissive, or even opaque in some instances.

When the electrical drive between the variable electrode and the fixed electrode is removed, the electrostatic force on the variable electrode is likewise removed. The spring constant present in the resilient layer 402 and the conductor 404 causes the shade to roll up back to its original, tightly-wound position. Because movement of the shade is controlled by a primarily capacitive circuit, current essentially only flows while the shade is either rolling out or rolling up. As a result, the average power consumption of the shade is extremely low. In this way, several standard AA batteries may be used to operate the shade for years, at least in some instances.

In one example, the substrate 302 may be 3 mm thick clear glass commercially available from the assignee. An acrylic-based adhesive having a low haze may be used for adhesive layer 310. Sputtered ITO having a resistance of 100-300 ohms/square may be used for the conductor 306. The polymer film may be a low-haze (e.g., <1% haze) PET material that is 12 microns thick. A PVC-based ink available from Sun Chemical Inc. applied to 3-8 microns thickness may be used as the decorative ink 406. A PEN material commercially available from DuPont that is 6, 12, or 25 microns thick may be used as the resilient layer 402. For an opaque conductor 406, evaporated Al that has a nominal thickness of 375 nm may be used. For a transparent option, sputtered ITO may be used. In both cases, the resistance may be 100-400 ohms/square. The ITO or other conductive material(s) may be sputtered onto, or otherwise formed on, their respective polymer carrier layers in certain example embodiments. Of course, these example materials, thicknesses, electrical properties, and their various combinations and sub-combinations, etc., should not be deemed limiting unless specifically claimed.

As will be appreciated from the description above, the dynamic shade mechanism uses a coiled polymer with a conductive layer. In certain example embodiments, the conductor 402 may be formed to be integral with the polymer 402, or it may be an extrinsic coating that is applied, deposited, or otherwise formed on the polymer 402. As also mentioned above, decorative ink 406 may be used together with a transparent conductor material (e.g., based on ITO) and/or an only partially transparent or opaque conductive layer. An opaque or only partially transparent conductive layer may obviate the need for ink in certain example embodiments. In this regard, a metal or substantially metallic material may be used in certain example embodiments. Aluminum is one example material that may be used with or without a decorative ink.

One or more overcoat layers may be provided on the conductor to help reduce the visible light reflection and/or change the color of the shade to provide a more aesthetically pleasing product, and/or by "splitting" the conductor so that a phase shifter layer appears therebetween. Overcoats thus may be included to improve the aesthetic appearance of the overall shade. The shutter 312 thus may include a reflection-reducing overcoat, dielectric mirror overcoat, or the like. Such reflection-reducing overcoats and dielectric mirror overcoats may be provided over a conductor 404 and on a major surface of the shade polymer 402 comprising (for example) PEN opposite decorative ink 406. It will be appreciated, however, that the ink 406 need not be provided, e.g., if the conductor 404 is not transparent. Mirror coatings such as, for example, Al, may obviate the need for decorative ink 406. It also will be appreciated that the reflection-reducing overcoat and the dielectric mirror overcoat may be provided on major surfaces of the shade polymer 402 comprising (for example) PEN opposite the conductor 404 in certain example embodiments.

In addition to or in place of using optical interference techniques to reduce reflection, it also is possible to add a textured surface to the base polymer, modifying the conductive layer chemically or physically, and/or add an ink layer, e.g., to accomplish the same or similar ends, achieve further reductions in unwanted reflection, etc.

Given that the thin film and/or other materials comprising the shutter should survive numerous rolling and unrolling operations in accordance with the functioning of the overall shade, it will be appreciated that the materials may be selected, and that the overall layer stack formed, to have mechanical and/or other properties that facilitate the same. For example, an excess of stress in a thin film layer stack typically is seen as disadvantageous. However, in some instances, excess stress can lead to cracking, "delamination"/removal, and/or other damage to the conductor 404 and/or an overcoat layer or layers formed thereon. Thus, low stress (and in particular low tensile stress) may be particularly desirable in connection with the layer(s) formed on the shutters' polymer bases in certain example embodiments.

In this regard, the adhesion of sputtered thin films depends on, among other things, the stress in the depositing film. One way stress can be adjusted is with deposition pressure. Stress versus sputter pressure does not follow a monotonic curve but instead inflects at a transition pressure that in essence is unique for each material and is a function of the ratio of the material's melting temperature to the substrate temperature. Stress engineering can be accomplished via gas pressure optimizations, bearing these guideposts in mind.

Other physical and mechanical properties of the shade that may be taken into account include the elastic modulus of the polymer and the layers formed thereon, the density ratio of the layers (which may have an effect on stress/strain), etc. These properties may be balanced with their effects on internal reflection, conductivity, and/or the like.

As is known, temperatures internal to an IG unit may become quite elevated. For example, it has been observed that an IG unit in accordance with the FIG. 2 example and including a black pigment may reach a temperature of 87 degrees C., e.g., if the black portion of the shade is facing the sun in elevated temperature, high solar radiation climates (such as, for example, in areas of the southwest United States such as Arizona). The use of a PEN material for the rollable/unrollable polymer may be advantageous, as PEN has a higher glass transition temperature (~120 degrees C.), compared to other common polymers such as PET (Tg=67-81 degrees C.), Poly Propylene or PP (Tg=~32-32 degrees C.). Yet if the PEN is exposed to temperatures approaching the glass transition temperature, the performance of the material's otherwise advantageous mechanical properties (including its elastic modulus, yield strength, tensile strength, stress relaxation modulus, etc.) may degrade over-time, especially with elevated temperature exposure. If these mechanical properties degrade significantly, the shade may no longer function (e.g., the shade will not retract).

In order to help the shade better withstand elevated temperature environments, a substitution from PEN to polymers with better elevated temperature resistance may be advantageous. Two potential polymers include PEEK and Polyimide (PI or Kapton). PEEK has a Tg of ~142 degrees C. and Kapton HN has a Tg of ~380 degrees C. Both of these materials have better mechanical properties in elevated temperature environments, compared to PEN. This is especially true at temperature above 100 degrees C. The following chart demonstrates this, referencing mechanical properties of PEN (Teonex), PEEK, and PI (Kapton HN). UTS stands for ultimate tensile strength, in the chart.

| | | PEN | PEEK | PI |
|---|---|---|---|---|
| 25 degrees C. | UTS (psi) | 39,000 | 16,000 | 33,500 |
| | Modulus (psi) | 880,000 | 520,000 | 370,000 |
| | Yield (psi) | 17,500 | | 10,000 |
| 200 degrees C. | UTS (psi) | 13,000 | 8,000 | 20,000 |
| | Modulus (psi) | | | 290,000 |
| | Yield (psi) | <1,000 | | 6,000 |
| Tg | | ~121 degrees C. | ~143 degrees C. | ~380 degrees C. |

It will be appreciated that the modification of the shade base material from its current material (PEN) to an alternate polymer (e.g., PEEK or PI/Kapton) that has increased elevated temperature mechanical properties may be advantageous in the sense that it may enable the shade to better withstand internal IG temperatures, especially if the shade is installed in higher temperature climates. It will be appreciated that the use of an alternative polymer may be used in connection with the shutter and/or the on-glass layer in certain example embodiments.

In addition, or as an alternative, certain example embodiments may use a dyed polymer material. For example, a dyed PEN, PEEK, PI/Kapton, or other polymer may be used to created shades with an assortment of colors and/or aesthetics. For instance, dyed polymers may be advantageous for embodiments in transparent/translucent applications, e.g., where the shade conductive layer is a transparent conductive coating or the like.

Alternate conductive materials that beneficially modify the spring force of the coiled shade to make it usable for various lengths may be used. In this regard, properties of the conductive layer that increase the strength of the coil include an increase in the elastic modulus, an increase in the difference in coefficient of thermal expansion (CTE) between the polymer substrate and the conductive layer, and an increase in the elastic modulus to density ratio. Some of the pure metals that can be used to increase coil strength compared to Al or Cr include Ni, W, Mo, Ti, and Ta. The elastic modulus of studied metal layers ranged from 70 GPa for Al to 330 GPa for Mo. The CTE of studied metal layers ranged from $23.5\times10^{-6}$/k for Al down to $4.8\times10^{-6}$/k for Mo. In general, the higher the elastic modulus, the higher the CTE mismatch between the PEN or other polymer and the metal, the lower the density, etc., the better the material selection in terms of coil formation. It has been found that incorporating Mo and Ti based conductive layers into shades has resulted in a spring force of the coil that is significantly higher than that which is achievable with Al. For example, a polymer substrate based on PEN, PEEK, PI, or the like, may support (in order moving away from the substrate) a layer comprising Al followed by a layer comprising Mo. Thin film layer(s) in a conductive coating and/or a conductive coating itself with a greater modulus and lower CTE than Al may be provided.

A PEN, PI, or other polymer substrate used as a shutter may support a thin layer comprising Al for stress-engineering purposes, with a conductive layer comprising Mo, Ti, or the like directly or indirectly thereon. The conductive layer may support a corrosion-resistant layer comprising Al, Ti, stainless steel, or the like. The side of the substrate opposite these layers optionally may support a decorative ink or the like.

Certain example embodiments may include microscopic perforations or through-holes that allow light to pass through the shade and provide progressive amounts of solar transmittance based on the angle of the sun.

Further manufacturing, operation, and/or other details and alternatives may be implemented. See, for example, U.S. Pat. Nos. 8,982,441; 8,736,938; 8,134,112; 8,035,075; 7,705,826; and 7,645,977, as well as U.S. Publication No. 2020/0011120; the entire contents of each of which is hereby incorporated herein by reference. Among other things, perforation configurations, polymer materials, conductive coating designs, stress engineering concepts, building-integrated photovoltaic (BIPV), and other details are disclosed therein and at least those teachings may be incorporated into certain example embodiments.

As will be appreciated from the description above, one issue associated with the dynamic shade design relates to formation of the retractable shutter. In particular, care may be taken to select and implement materials with a spring force sufficient to enable automatic retraction over time. It oftentimes will be important to tightly control manufacturing parameters to ensure that the shutter is properly created so as to have a spring force sufficient for retraction, and to ensure that the spring force remains sufficient to cause retraction over the life of the window or other product into which the shutter is integrated. If the spring constant is not sufficient, or if it degrades over time, the shutter may become "stuck" in an extended or partially extended position. This may be the case even if voltage is not applied, simply because the spring constant will be insufficient to cause the re-rolling. Furthermore, even if spring constants are properly formed and remain sufficiently high to at least in theory provide for retraction over time, after repeat usage, electrostatic charges can build up. This charge build-up may cause the shutter to become "stuck" in an extended or partially extended position in a manner similar to the above, even when power is not provided. "Pole swapping," which in this context refers to a natural phenomenon that can hinder the operation of the shutter and might be thought of as relating to surface charge (on the dielectric surface) or semi-permanent electrostatic polarization (in the dielectric volume), also can hinder the operation of the shutter. And because of the closed system, it can be difficult and sometimes even impossible to repair and/or replace faulty shutters and/or shutters that have "worn out" over time, systems where excessive charges have built-up and/or where poles have switched, etc.

Figure 5:
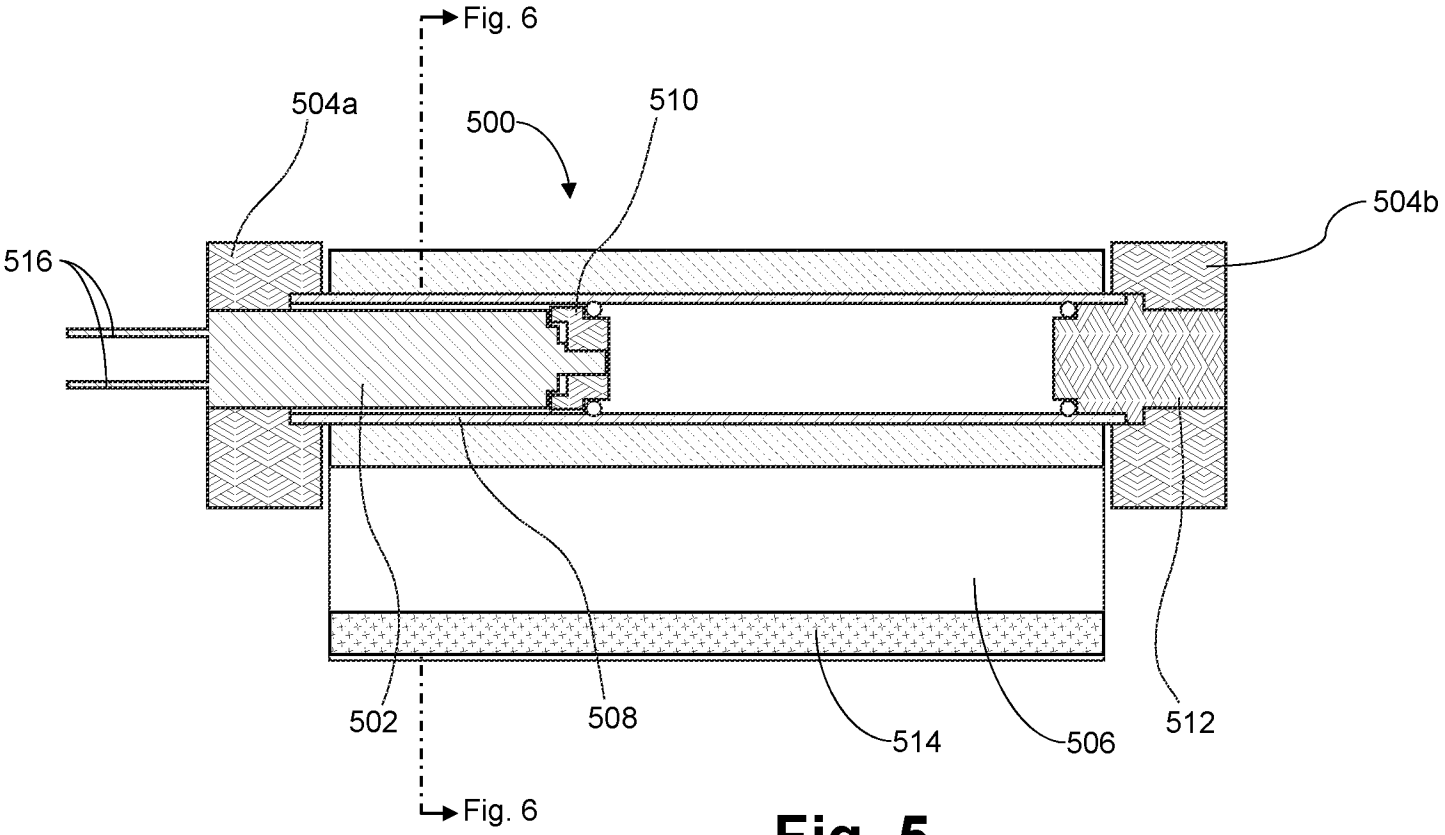
FIG. 5 is a cross-sectional view of a portion of an IG unit incorporating a motor in the gap or cavity thereof, in accordance with certain example embodiments.
Figure 6:
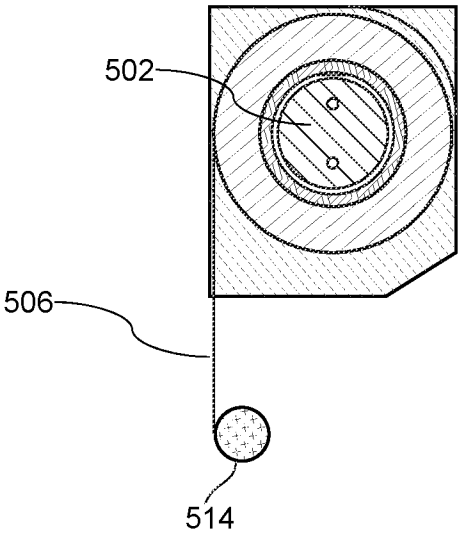
FIG. 6 is a cross-sectional view through the FIG. 5 example, in accordance with certain example embodiments.

To help address these and/or other issues, certain example embodiments incorporate a miniaturized motor into the gap or cavity of the IG unit. The motor helps drive the shade between extended and retracted positions. In this regard, FIG. 5 is a cross-sectional view of a portion of an IG unit incorporating a motor in the gap or cavity thereof in accordance with certain example embodiments, and FIG. 6 is a cross-sectional view through the FIG. 5 example in accordance with certain example embodiments. As shown perhaps best in FIG. 5, the assembly 500 shown in FIG. 5 includes a gear motor 502 supported by first and second mounting blocks 504*a*-504*b*. Although only one motor is shown in FIG. 5, multiple motors may be provided in an assembly, e.g., one motor may be provided in each of the mounting blocks 504*a*-504*b*. In certain example embodiments, the mounting blocks 504*a*-504*b* may be provided interior to the spacer assembly. In certain example embodiments, the spacer assembly may be notched out to accommodate and potentially help support the mounting blocks 504*a*-504*b*. In certain example embodiments, the mounting blocks 504*a*-504*b* may be provided outside of the spacer system, with the motor being inside the spacer system and connected to the mounting blocks 504*a*-504*b* using a rod or other member provided through holes or other openings formed or otherwise present in the spacer system.

The motor 502 helps drive the shade 506 to the extended and retracted positions. The motor 502 may be a brush or brushless motor in different example embodiments, e.g., with adequate torque and speed to drive the extension and retraction of the shade 506. As one example, Pololu Robitics and Electronics manufactures a 700:1 Sub-Micro Plastic Planetary Gearmotor that is 6 mm in diameter and 21 mm in length, with a shaft diameter of 2 mm. This unit would fit into the IG unit cavity. This 700:1 gear ratio motor weighs 1.3 grams and has a no-load speed at 6V of 90 rpm and a no-load current at 6V of 45 mA, as well as a stall current of 400 mA with a stall torque of 12 oz-in at 6V. With a load estimated at 800 grams, the worst case loading at the end of the motor would yield low (<1 ksi) stress and low deflection (e.g., <0.005"). Thus, this gearmotor is one example that has sufficient torque to work at a practical speed for window applications of varying sizes.

For instance, in certain example embodiments, the motor powers a spinning rod or tube 508. The shade 506 is wrapped around the rod 508 and extends when the motor 502 turns the rod 508 in a first direction and retracts when the motor 502 turns the rod 508 in a second direction opposite the first direction. As shown in FIG. 5, for example, the extension and retraction is facilitated by a pulley and O-ring assembly 510, together with the dummy pulley and O-ring assembly 512. In certain example embodiments, the rod or winding tube may be provided with a profile that is shaped to assist the shade in retracting in a straight manner, reducing the likelihood of telescoping.

The rod 508 is able to ride within the mounting blocks 504*a*-504*b*. This arrangement provides added strength and support for the rod 508, which is weighted by the shade 506 and potentially also the motor 502 (e.g., when the motor is partially or fully included in the winding rod or tube 508. The mounting blocks 504*a*-504*b* (which may be end blocks in certain example embodiments) may include bearings, bushings, and/or the like, to allow for rotation of the winding rod or tube 508.

As can be seen from FIG. 6, for example, the motor 502 may house the rod 508 in certain example embodiments. In certain example embodiments, the electronic drive motor 502 may be connected to the winding rod or tube 508 via a mechanical mechanism including, for example, screws, gears, a belt, friction, and/or other fastening means. Alternatively, in certain example embodiments, the electronic drive motor 502 may be fully or partially located within the winding rod or tube 508 itself, e.g., as a direct drive system where the window shade material is wrapped around it and supported by the mounting blocks 504*a*-504*b* at each end.

Regardless of whether the motor 502 houses the rod 508 or vice versa, the rod 508 may be positioned close to the inner surface of one of the substrates. The extension and retraction movements may be accomplished without the shade 506 contacting the inner surface in some instances. In certain example embodiments, a weight 514 may be provided at an end of the shade 506, e.g., to help keep the shade 506 in place once extended in certain example embodiments.

The motor 502, tube 508, and shade 506 all fit inside IG unit cavity. In certain example embodiments, the motor 502 has a small profile suitable for this purpose. For instance, commercially available motor assemblies less than about 30 mm by 30 mm, more preferably less than 25 mm by 25 mm, and still more preferably with a width less than about 10 mm or 15 mm, may be used in connection with certain example embodiments. In certain example embodiments, the assembly 500 may be sized, shaped, and arranged to be concealed by the frit perimeter border to enable full blackout beyond edges of the shade.

In certain example embodiments, the gear motor may be designed to be either hardwired or to run off a battery or a solar battery system (e.g., which may be a separate BIPV component, incorporated into the IG unit itself, etc.). Electrical connection(s) 516 to the motor 502 may be established via solder to a frit or conductor penetrating edge seal. The conductor may in certain example embodiments be a wire or ribbon.

Certain example embodiments may include a programmable controller or other control circuitry, e.g., to trigger the opening and closing of the shade based on ambient light levels, time, or output from other logic and sensors. In a similar vein, the motor or the controller attached to it may include a sensing mechanism that allows for feedback to control shade position, e.g., to help correct for detected skewing/telescoping, to reduce the risk of over-extension, etc.

Using a motor to drive a shade within the cavity of an IG unit may be desirable in certain example embodiments. An electrostatically-driven shade may require fabrication based on materials formed to have a specific spring constant that survives over a long period of time. In such instances, the ability to coil back up after being uncoiled can depend on the spring constant remaining more or less stable (e.g., within predetermined tolerances) over time. By contrast, using a motor helps reduce this issue, as the motor is primarily responsible for the winding and unwinding. As a result, the spectrum of shade materials that may be used in certain example embodiments is potentially broader than a purely electrostatically-driven shade. A wide variety of shade materials may be used to provide various colors, levels of light filtration, printed or otherwise formed patterns, and/or the like. Potential materials include but are not limited to materials comprising polycarbonate, acrylic, PEN, PET, PVC, PE, PP, fluoropolymers, etc. Durability concerns therefore may be addressed, as spring force concerns do not dominate over time.

Inasmuch as electrostatic extension and/or retraction need not be provided in certain example embodiments, the attendant need for dielectrics on the shutter and/or substrate may be omitted in certain example embodiments. In a similar vein, the need for conductive layers on one or both of the shutter and substrate may be omitted in certain example embodiments. This may simplify the overall frit pattern including, for example, the use of silver or other conductive frit, the use of black frit to mask the conductive frit, etc. The need for an anchor or bottom stop may not be needed, as the motor may define the maximum travel of the shade in certain example embodiments.

Compared to an electrostatically-driven shade, a simplified power supply and less energy may be used in certain example embodiments that implement a motor-driven shade. In terms of energy expenditure, assuming that a 3.6V motor operating at 0.035 amps with an 80% brushless motor efficiency is provided, and assuming that it takes about 20 seconds to extend or retract the shade, about 20% less energy may be used in the motor-driven shade design compared to a comparable electrostatically-driven shade over the course of a day with 14 operations. With a daily usage under these circumstances requiring 82 joules, photovoltaic members incorporated into the windows may be used to power the shade. For instance, typical photovoltaic operation may provide about 19.5 joules of energy. A battery large enough to store about 4 days' worth of power could be incorporated into the design so that no external power source is needed in certain example embodiments. Overall, certain example embodiments may reduce energy consumption because electrostatic forces are not needed to hold the shade in the extended position.

Certain example embodiments have been described as taking the place of electrostatic extension/retraction embodiments. Certain example embodiments thus may lack conductors and/or dielectrics on the shutter and/or the substrate in certain example embodiments. In certain example embodiments, the motor-driven extension/retraction may be able to operate with existing shade material and backplane options. This may be useful for providing static adhesion for blackout and/or other purposes.

In this regard, certain example embodiments may use electrostatic and/or other forces to hold the shade to the substrate. This may be accomplished without using electrostatic forces, e.g., by using a weight (as noted above), one or more magnet assemblies (e.g., with a first magnet assembly on the shade cooperating with a second magnet assembly on the substrate), a spring, and/or other mechanism to maintain shade flat against window substrate. This may be useful in helping to create a full blackout of light, which is desirable in some instances. In certain example embodiments, holding the shade in place additionally or alternatively may be desirable when the IG unit is used in a door or other object that is expected to move. Similarly, by providing holding mechanisms such as magnets, springs, electrostatic forces, etc., it becomes possible to reduce the effect of sagging of the shade, especially in non-vertical installations (e.g., where the shade unfurls right-to-left or left-to-right as in a generally horizontal installation).

Figure 7:
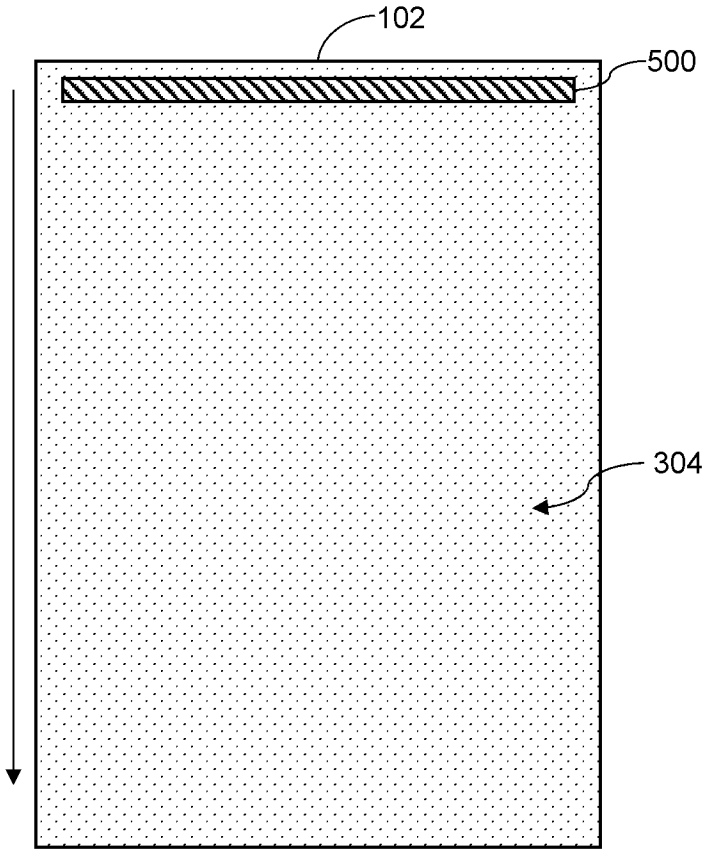
FIG. 7 is a plan view of a substrate incorporating on-glass components from the FIG. 2 example IGU, along with the motor assembly from FIG. 5, in accordance with certain example embodiments.

When electrostatic forces are used to hold the shade to one of the substrates, the existing stacks of conductive materials and dielectrics may be used. FIG. 7, for instance, is a plan view of a substrate incorporating on-glass components 304 from the FIG. 2 example IGU, along with the motor assembly 500 from FIG. 5, in accordance with certain example embodiments. As shown in FIG. 7, the on-glass components 304 may extend over all or substantially all of the substrate 102, e.g., over all or substantially all of the area between a first peripheral edge where the motor assembly 500 is provided and a second peripheral edge opposite the first peripheral edge to which the shade extends.

Figure 8:
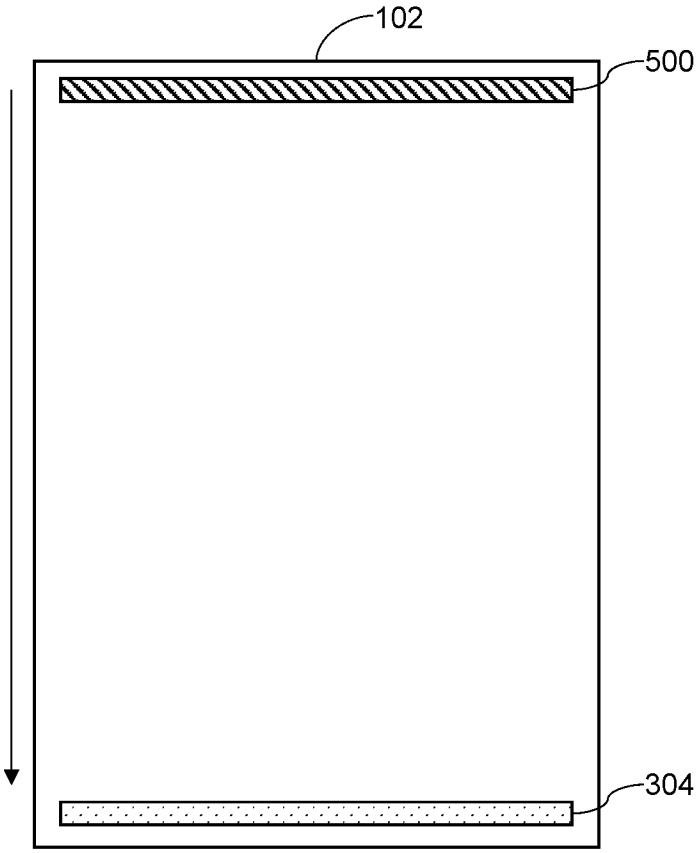
FIG. 8 is a plan view of a substrate incorporating a different configuration of on-glass components from the FIG. 2 example IGU, along with the motor assembly from FIG. 5, in accordance with certain example embodiments.

In certain example embodiments, the on-glass components 304 may be limited to one or more areas of the substrate 102. For instance, FIG. 8 is a plan view of a substrate incorporating a different configuration of on-glass components 304 from the FIG. 2 example IGU, along with the motor assembly 500 from FIG. 5, in accordance with certain example embodiments. FIG. 8 is similar to FIG. 7 in that the substrate supports the on-glass components 304 as described above. However, in FIG. 8, the on-glass components 304 are provided only at the second peripheral edge to which the shade extends. In this way, less electrostatic force may be needed to hold the substrate in place, e.g., because a smaller area is being energized. Although a generally rectangular area is shown in FIG. 8, different sizes and/or shapes may be provided in different example embodiments. Similarly, although there is one area provided in FIG. 8, multiple partitioned zones may be provided along the same or different general area as depicted in FIG. 8.

Figure 9:
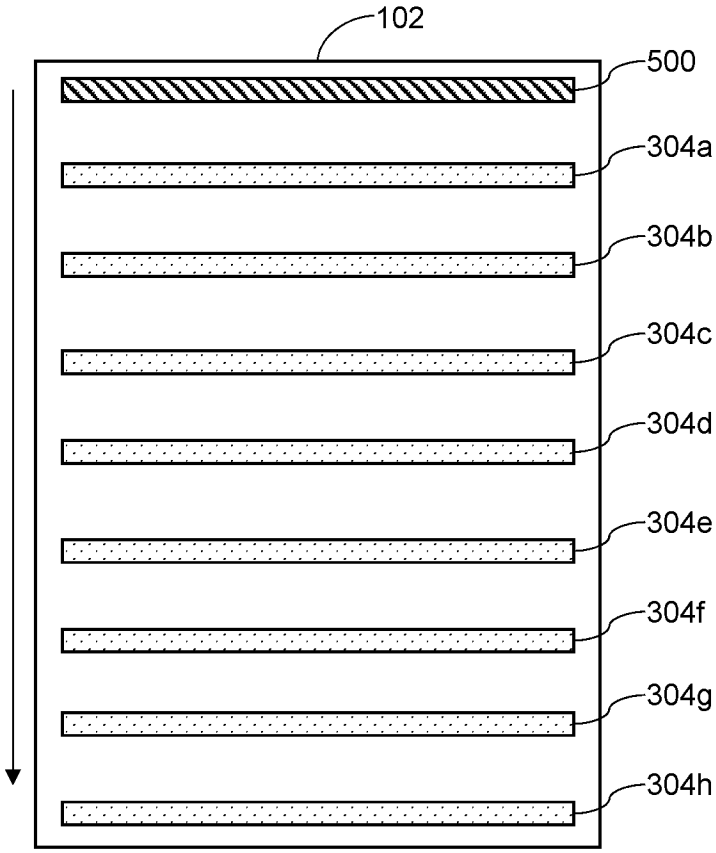
FIG. 9 is a plan view of a substrate incorporating multiple areas of on-glass components from the FIG. 2 example IGU, along with the motor assembly from FIG. 5, in accordance with certain example embodiments.

In certain example embodiments, it may be desirable to hold the shade to the glass substrate at multiple locations. This may present a visual appears that is more uniform and thus more aesthetically pleasing. For instance, different areas of contact and non-contact (e.g., intermittent contact) may create a rippled or bubbled look, which may be aesthetically displeasing in certain example embodiments. Thus, certain example embodiments may incorporate multiple areas for on-glass components. In this regard, FIG. 9 is a plan view of a substrate incorporating multiple areas of on-glass components from the FIG. 2 example IGU, along with the motor assembly 500 from FIG. 5, in accordance with certain example embodiments. Multiple areas **304*a*-304*h* are shown. Each area spans a width of the substrate 102 equal to the shade's width in this example. It will be appreciated that different example embodiments may have smaller widths or larger widths (e.g., to the edge of the substrate 102, or at least beyond the width of the shade). Although eight sections are shown in the FIG. 9** example, more or fewer areas may be provided in different example embodiments.

Figure 10:
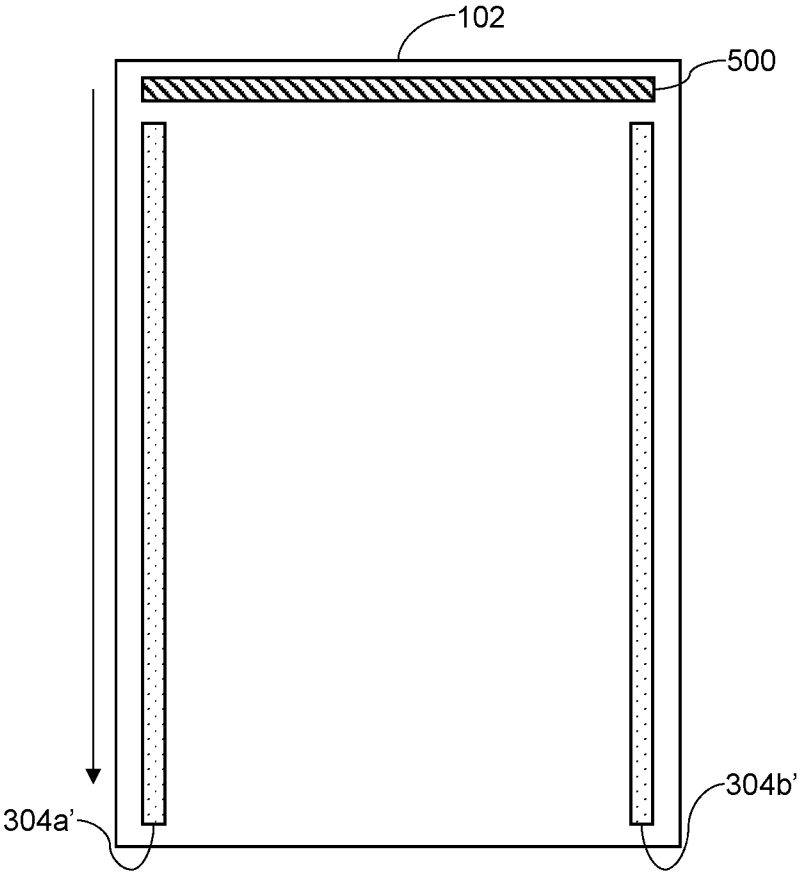
FIG. 10 is a plan view of a substrate incorporating another configuration including multiple areas of on-glass components from the FIG. 2 example IGU, along with the motor assembly from FIG. 5, in accordance with certain example embodiments.

Generally horizontal arrangements for the on-glass components were shown in FIGS. 8-9, e.g., for use shades that extend/retract in generally vertical manners. However, different example embodiments may use different configurations for the on-glass components and/or for the direction of the shade extension/retraction. For instance, FIG. 10 is a plan view of a substrate incorporating another configuration including multiple areas of on-glass components from the FIG. 2 example IGU, along with the motor assembly 500 from FIG. 5, in accordance with certain example embodiments. As shown in FIG. 10, generally vertical areas **304*a*'-304*b*' may be provided for the on-glass components. These generally vertical areas may be provided at the peripheral edges perpendicular to the edge from which the shade extends and to which it retracts. In certain example embodiments, the length of the vertical areas 304*a*'-304*b*' may be substantially the entirety of the substrate 102, e.g., at or close to the second peripheral edge to which the shade extends. Similar to the description above, multiple vertical areas may be provided in center sections of the substrate 102, between the vertical areas 304***a*'-304*b*', in certain example embodiments.

In certain example embodiments, a horizontal area may be provided between (e.g., connecting or not connecting) with the vertical areas 304*a*'-304*b*' shown in FIG. 10. In certain example, other patterns (e.g., grid-like patterns, diamond-like patterns, and/or the like) may be provided to help adhere the shutter to the on-glass components provided on the substrate.

The same or similar patterns as those shown in, and described in connection with, FIGS. 7-10 may be used in connection with the shutter. That is, the shutter 312 described above may have the conductive material applied thereon as a blanket coating regardless of whether and how the on-glass components are patterned, in certain example embodiments. In other example embodiments, the shutter 312 described above may have the conductive material applied thereon in a pattern matching that shown in, and described in connection with, FIGS. 7-10. In such cases, the on-glass components may be blanket coated across all or substantially all of the substrate 102, the on-glass components may be patterned into complementary areas so as match the pattern provided for the shutter (e.g., so that they are in registration with one another when the shutter is extended), etc. In other words, in certain example embodiments, the shade may be electrostatically couplable to one of the first and second substrates when the shade is extended via complementary electrostatic connection areas provided to the shade and the one of the first and second substrates, e.g., with the complementary electrostatic connection areas comprising a plurality of first areas on the one of the first and second substrates and a plurality of second areas on the shade, and with these first and second areas being sized, shaped, and arranged to be substantially in registration with one another when the shade is extended.

By having the shade electrostatically held to the window, much lower voltage may be used, e.g., compared to embodiments where electrostatic forces are used to extend the shade, optionally retract it, and also hold it. In certain example embodiments, in use, the motor drives the shade, and the electrostatic force is triggered after the shade is extended and stationary so that it can be held in place. This helps hold the shade in the more aesthetically pleasing unfurled position. Electrostatic forces are not used to extend and/or retract the shade in certain example embodiments and, instead, in such embodiments, the motor may be used for extension/retraction.

As alluded to above, certain example embodiments may be used in generally vertical and/or generally horizontal configurations. In such cases, a motor may be used to extend/retract the shade, and optionally electrostatic forces may be used to hold the shutter against the substrate in certain example embodiments.

Regardless of window orientation, having the shade held against the glass advantageously may help improve solar heat gain coefficient (SHGC). SHGC is the fraction of solar radiation admitted through a window, door, or skylight (either transmitted directly and/or absorbed), and subsequently released as heat inside a home or other structure. From a simplistic perspective, if the shade is away from the glass (e.g., if the shade hangs in the middle of the two substrates and, for instance, in the center of an IG cavity or the like), the sun's energy will enter the cavity created between the outer glass and the shade. However, if the shade is against the outer glass, more of the energy will be rejected because the air inside isn't heated as much and, thus, SHGC is improved.

Figure 11:
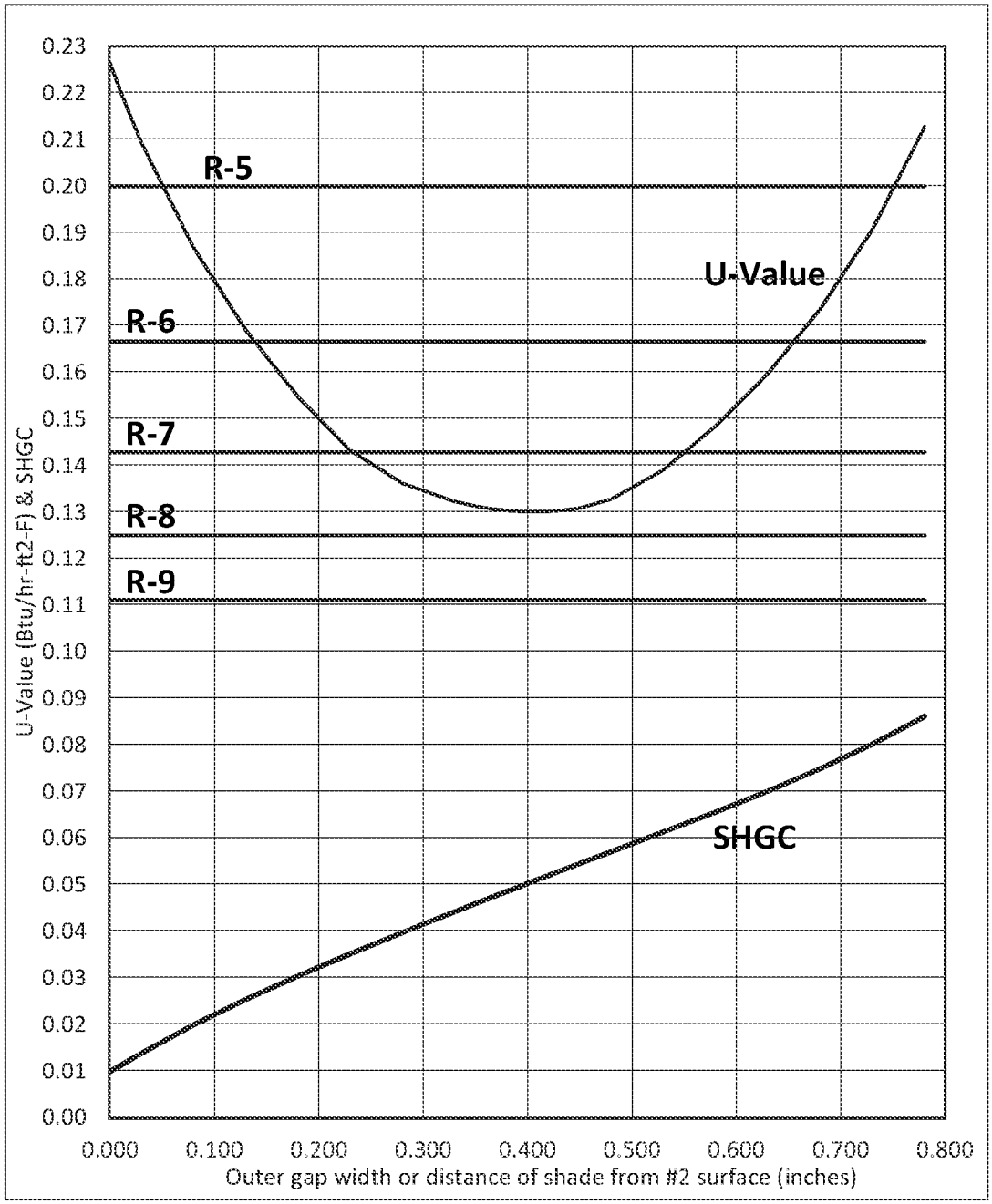
FIG. 11 is a graph plotting U- and SHGC-values against the distance of a shade from the substrates.

To help demonstrate the SHGC improvements, FIG. 11 is a graph plotting U- and SHGC-values against the distance of a shade from the substrates. As is known, U-Value (also sometimes called U-Factor) represents the air-to-air thermal conductance of 39" high glazing and associated air films. In FIG. 11, a simple aluminized shade having excellent thermal-optical properties with a solar reflectance of 87% is used in connection with an IG unit. The IG unit itself includes first and second glass substrates that are spaced apart by 0.78". Thus, the shade is on surface 2 (the inner surface of the outer substrate) at the 0" position, whereas the shade is on surface 3 (the inner surface of the inner substrate) at the 0.78" position. The IG unit cavity has a 90% argon fill. Standard performance for different R-values also are indicated.

As shown in FIG. 11, with the motorized shade down and near the center, the SHGC is about 0.05. Moving the shade to surface 2 (left side of graph) reduces the SHGC to about 0.01. The U-value line represents the center-of-glass value of the unit. Its best performance is at U=0.13 Btu/hr-ft$^2$-F (R 7.7) when the shade is near the center of the gap. The simple aluminized shade thus allows the SHGC to be extremely low (e.g., potentially an order of magnitude lower than typical solar control glazings). If the shade is painted white or gray, for example, the SHGC may not be as low as shown in FIG. 11. However, the effect of moving the blind from the center of the gap to surface 2 may be more substantial.

The IG units described herein may incorporate low-E coatings on any one or more of surfaces 1, 2, 3, and 4. As noted above, for example, such low-E coatings may serve as the conductive layers for shades. In other example embodiments, in addition to or apart from serving and conductive layers for shades, a low-E coating may be provided on another interior surface. For instance, a low-E coating may be provided on surface 2, and a shade may be provided with respect to surface 3. In another example, the location of the shade and the low-E coating may be reversed. In either case, a separate low-E coating may or may not be used to help operate the shade provided with respect to surface three. In certain example embodiments, the low-E coatings provided on surfaces 2 and 3 may be silver-based low-E coatings. Example low-E coatings are set forth in U.S. Pat. Nos. 9,802,860; 8,557,391; 7,998,320; 7,771,830; 7,198,851; 7,189,458; 7,056,588; and 6,887,575; the entire contents of each of which is hereby incorporated by reference. Low-E coatings based on ITO and/or the like may be used for interior surfaces and/or exterior surfaces. See, for example, U.S. Pat. Nos. 9,695,085 and 9,670,092; the entire contents of each of which is hereby incorporated by reference. These low-E coatings may be used in connection with certain example embodiments.

Antireflective coatings may be provided on major surfaces of the IG unit, as well. In certain example embodiments, an AR coating may be provided on each major surface on which a low-E coating and shade is not provided. Example AR coatings are described in, for example, U.S. Pat. Nos. 9,796,619 and 8,668,990 as well as U.S. Publication No. 2014/0272314; the entire contents of each of which is hereby incorporated by reference. See also U.S. Pat. No. 9,556,066, the entire contents of which is hereby incorporated by reference herein. These AR coatings may be used in connection with certain example embodiments.

The example embodiments described herein may be incorporated into a wide variety of applications including, for example, interior and exterior windows for commercial and/or residential application, skylights, doors, merchandizers such as refrigerators/freezers (e.g., for the doors and/or "walls" thereof), vehicle applications, etc.

Although certain example embodiments have been described in connection with IG units including two substrates, it will be appreciated that the techniques described herein may be applied with respect to so-called triple-IG units. In such units, first, second, and third substantially parallel spaced apart substrates are separated by first and second spacer systems, and shades may be provided adjacent to any one or more of the interior surfaces of the innermost and outermost substrates, and/or to one or both of the surfaces of the middle substrate. Similarly, the example embodiments described herein may be used in connection with other window assemblies such as, for example, vacuum insulating glass (VIG) units, laminated products, etc.

Although certain example embodiments have been described as incorporating glass substrates (e.g., for use of the inner and outer panes of the IG units described herein), it will be appreciated that other example embodiments may incorporate a non-glass substrate for one or both of such panes. Plastics, composite materials, and/or the like may be used, for example. When glass substrates are used, such substrates may be heat treated (e.g., heat strengthened and/or thermally tempered), chemically tempered, left in the annealed state, etc. In certain example embodiments, the inner or outer substrate may be laminated to another substrate of the same or different material.

As used herein, the terms "on," "supported by," and the like should not be interpreted to mean that two elements are directly adjacent to one another unless explicitly stated. In other words, a first layer may be said to be "on" or "supported by" a second layer, even if there are one or more layers therebetween.

In certain example embodiments, an insulating glass (IG) unit is provided. First and second substrates each have interior and exterior major surfaces, with the interior major surface of the first substrate facing the interior major surface of the second substrate. A spacer system helps to maintain the first and second substrates in substantially parallel spaced apart relation to one another and to define a gap therebetween. A shade is interposed between the first and second substrates. A motor is proximate to a first peripheral edge of the IG unit and interposed between the first and second substrates, with the motor being dynamically controllable to cause the shade to extend towards a second peripheral edge of the IG unit opposite the first peripheral edge and to cause the shade to retract from the second peripheral edge towards the first peripheral edge.

In addition to the features of the previous paragraph, in certain example embodiments, a spinnable tube may be provided, e.g., with the shade being wrapped around the tube, and with the motor being configured to spin the spinnable tube in a first direction to cause the shade to extend and in a second direction to cause the shade to retract.

In addition to the features of the previous paragraph, in certain example embodiments, first and second mounting blocks in which the tube is able to ride may be provided.

In addition to the features of either of the two previous paragraphs, in certain example embodiments, the motor may be external to and connected to the spinnable tube. Alternatively, in addition to the features of either of the two previous paragraphs, in certain example embodiments, the motor may be at least partially located within the spinnable tube as a part of a direct drive system.

In addition to the features of any of the four previous paragraphs, in certain example embodiments, a portion of the shade may be weighted so to promote contact between the shade and one of the first and second substrates when the shade is extended.

In addition to the features of any of the five previous paragraphs, in certain example embodiments, a magnet assembly may be provided, e.g., with the magnet assembly promoting contact between the shade and one of the first and second substrates when the shade is extended.

In addition to the features of any of the six previous paragraphs, in certain example embodiments, the shade may be electrostatically couplable to one of the first and second substrates when the shade is extended via complementary electrostatic connection areas provided to the shade and the one of the first and second substrates.

In addition to the features of the previous paragraph, in certain example embodiments, the complementary electrostatic connection areas may comprise a plurality of first areas on the one of the first and second substrates and a plurality of second areas on the shade, e.g., with the first and second areas being sized, shaped, and arranged to be substantially in registration with one another when the shade is extended. As an alternative, in addition to the features of the previous paragraph, in certain example embodiments, the complementary electrostatic connection areas may comprise a plurality of first areas on the one of the first and second substrates and a single second area on the shade, e.g., with the second area potentially covering substantially all of one surface of the shade. As another alternative, in addition to the features of the previous paragraph, in certain example embodiments, the complementary electrostatic connection areas may comprise a first area on the one of the first and second substrates and a second area on the shade. In such cases, the first area may be proximate to the second peripheral edge; the first area may be provided throughout the area between the first and second peripheral edges, and the second area may cover substantially all of one surface of the shade; etc. Furthermore, in some cases, the one of the first and second substrates may support, in order moving away therefrom and in the first area, a first conductive coating and a first dielectric coating; and the shade may include a shade polymer supporting a second conductive coating in at least the second area.

In certain example embodiments, a method of operating a dynamic shade in an insulating glass (IG) unit is provided. The method comprises having an IG unit of any one of the eight previous paragraphs, and selectively activating a power source to move the shade between extended and retracted positions.

In certain example embodiments, a method of making an insulating glass (IG) unit is provided. The method comprises having first and second substrates, each having interior and exterior major surfaces, the interior major surface of the first substrate facing the interior major surface of the second substrate; providing a motor connected to a shade; and connecting the first and second substrates to one another in substantially parallel, spaced apart relation, such that a gap is defined therebetween and such that the shade and the motor are located in the gap, with the motor being proximate to a first peripheral edge of the IG unit, the motor being dynamically controllable in use to cause the shade to extend towards a second peripheral edge of the IG unit opposite the first peripheral edge and to cause the shade to retract from the second peripheral edge towards the first peripheral edge.

In addition to the features of the previous paragraph, in certain example embodiments, a spinnable tube may be provided, e.g., with the shade being wrapped around the tube, and with the motor being configured to spin the spinnable tube in a first direction to cause the shade to extend and in a second direction to cause the shade to retract.

In addition to the features of the previous paragraph, in certain example embodiments, first and second mounting blocks in which the tube is able to ride may be provided, and the tube may be positioned in the first and second mounting blocks so that the tube is able to ride therein when the shade is extending and retracting.

In addition to the features of any of the three previous paragraphs, in certain example embodiments, the motor may be electrically connected to a power supply line to enable the motor to be powered from a power source outside of the gap.

In addition to the features of any of the four previous paragraphs, in certain example embodiments, the shade, in use, may be electrostatically couplable to one of the first and second substrates when the shade is extended via complementary electrostatic connection areas provided to the shade and the one of the first and second substrates.

In addition to the features of the previous paragraph, in certain example embodiments, the complementary electrostatic connection areas may comprise a first area on the one of the first and second substrates and a second area on the shade. For instance, in certain example embodiments, the first area may be provided throughout the area between the first and second peripheral edges, and the second area may cover substantially all of one surface of the shade; the one of the first and second substrates may support, in order moving away therefrom and in the first area, a first conductive coating and a first dielectric coating, with the shade including a shade polymer supporting a second conductive coating in at least the second area; etc.

While the invention has been described in connection with what is presently considered to be the most practical and preferred embodiment, it is to be understood that the invention is not to be limited to the disclosed embodiment and/or deposition techniques, but on the contrary, is intended to cover various modifications and equivalent arrangements included within the spirit and scope of the appended claims.

What is claimed is:

1. An insulating glass (IG) unit, comprising:

first and second substrates, each having interior and exterior major surfaces, the interior major surface of the first substrate facing the interior major surface of the second substrate;

a spacer system helping to maintain the first and second substrates in substantially parallel spaced apart relation to one another and to define a gap therebetween;

a shade interposed between the first and second substrates; and a motor proximate to a first peripheral edge of the IG unit and interposed between the first and second substrates, the motor being dynamically controllable to cause the shade to extend towards a second peripheral edge of the IG unit opposite the first peripheral edge and to cause the shade to retract from the second peripheral edge towards the first peripheral edge, wherein the shade is electrostatically couplable to one of the first and second substrates when the shade is extended, via complementary electrostatic connection areas provided to the shade and the one of the first and second substrates, and wherein the complementary electrostatic connection areas comprise at least one first area on the one of the first and second substrates to which the shade is electrostatically couplable, wherein each said first area having a first dimension in a first direction being parallel to a width of the substrate and a second dimension in a second direction being perpendicular to the first direction; the complementary electrostatic connection areas further comprising at least one second area on the shade, and the complementary areas being patterned and matched with the first and second areas being sized, shaped, and arranged to be substantially in registration with one another when the shade is extended;

wherein the one of the first and second substrates to which the shade is electrostatically couplable supports, in the at least one first area, a first conductive coating and a first dielectric coating that has a thickness up to 25 μm, the first conductive coating being interposed between the first dielectric coating and the one of the first and second substrates to which the shade is electrostatically couplable; and the shade includes a shade polymer supporting a second conductive coating in at least the one second area and a second dielectric coating that has a thickness up to 25 μm.

2. The IG unit of claim 1, further comprising a spinnable tube, the shade being wrapped around the tube, the motor being configured to spin the spinnable tube in opposite directions to cause the shade to extend and retract, wherein the motor with a low profile, the shade, and the tube are all fit inside the IG unit to be concealed to enable full blackout.

3. The IG unit of claim 2, further comprising first and second mounting blocks in which the tube is able to ride.

4. The IG unit of claim 2, wherein the motor is external and connected to the spinnable tube.

5. The IG unit of claim 2, wherein the motor is at least partially located within the spinnable tube as a part of a direct drive system.

6. The IG unit of claim 1, wherein the second area covers substantially all of one surface of the shade.

7. The IG unit of claim 1, wherein the complementary electrostatic connection areas comprise one second area on the shade and one first area on the one of the first and second substrates.

8. The IG unit of claim 7, wherein the one first area is proximate to the second peripheral edge.

9. The IG unit of claim 7, wherein the one second area covers substantially all of one surface of the shade.

10. The IG unit of claim 1, wherein the at least one first area on the one of the first and second substrates are discrete and spaced apart, the first areas being provided at peripheral edges of the one of the first and second substrates to which the shade is electrostatically couplable perpendicular to the first and second peripheral edges of the IG unit.

11. The IG unit of claim 10, wherein the complementary electrostatic connection areas comprise one second area on and covering substantially all of the shade.

12. The IG unit of claim 1, wherein the at least one first area on the one of the first and second substrates are discrete and spaced apart, the first areas being provided at peripheral edges of the one of the first and second substrates to which the shade is electrostatically couplable parallel to the first and second peripheral edges of the IG unit.

13. The IG unit of claim 12, wherein the complementary electrostatic connection areas comprise one second area on and covering substantially all of the shade.

14. A method of making an insulating glass (IG) unit, the method comprising:

having first and second substrates, each having interior and exterior major surfaces, the interior major surface of the first substrate facing the interior major surface of the second substrate;

providing a motor connected to a shade; and connecting the first and second substrates to one another in substantially parallel, spaced apart relation, such that a gap is defined therebetween and such that the shade and the motor are located in the gap, with the motor being proximate to a first peripheral edge of the IG unit, the motor being dynamically controllable in use to cause the shade to extend towards a second peripheral edge of the IG unit opposite the first peripheral edge and to cause the shade to retract from the second peripheral edge towards the first peripheral edge, wherein the shade is electrostatically couplable to one of the first and second substrates when the shade is extended, via complementary electrostatic connection areas provided to the shade and the one of the first and second substrates, and wherein the complementary electrostatic connection areas comprise at least one first area on the one of the first and second substrates to which the shade is electrostatically couplable, wherein each said first area having a first dimension in a first direction being parallel to a width of the substrate and a second dimension in a second direction being perpendicular to the first direction; the complementary electrostatic connection areas further comprise at least one second area on the shade; and the complementary areas can be patterned and matched with the first and second areas being sized, shaped, and arranged to be substantially in registration with one another when the shade is extended;

wherein the one of the first and second substrates to which the shade is electrostatically couplable supports, in the at least one first area, a first conductive coating and a first dielectric coating that has a thickness up to 25 μm, the first conductive coating being interposed between the first dielectric coating and the one of the first and second substrates to which the shade is electrostatically couplable; and the shade includes a shade polymer supporting a second conductive coating in at least the one second area and a second dielectric coating that has a thickness up to 25 μm.

15. The method of claim 14, further comprising providing a spinnable tube, the shade being wrapped around the tube, the motor being configured in use to spin the spinnable tube in opposite directions to cause the shade to extend and retract.

16. The method of claim 15, further comprising: providing first and second mounting blocks; and positioning the tube in the first and second mounting blocks so that the tube is able to ride therein when the shade is extending and retracting.

17. The method of claim 14, further comprising electrically connecting the motor to a power supply line to enable the motor to be powered from a power source outside of the gap.

18. The method of claim 14, wherein the at least one first area comprises a plurality of discrete, spaced apart first areas on the one of the first and second substrates.

19. The method of claim 18, wherein the second area covers substantially all of one surface of the shade.

20. The method of claim 18, wherein:

the one of the first and second substrates to which the shade is electrostatically couplable supports, in the at least one first area, a first conductive coating and a first dielectric coating, the first conductive coating being interposed between the first dielectric coating and the one of the first and second substrates to which the shade is electrostatically couplable; and the shade includes a shade polymer supporting a second conductive coating in at least the second area.

21. A method of operating a dynamic shade in an insulating glass (IG) unit, the method comprising:

having an IG unit of claim 1; and selectively activating a power source to move the shade between extended and retracted positions.

* * * * *